United States Patent [19]

Borel

[11] Patent Number: 4,928,737

[45] Date of Patent: May 29, 1990

[54] FABRIC FOR THE SHEET FORMING SECTION OF A PAPERMAKING MACHINE

[75] Inventor: Georg Borel, Reutlingen, Fed. Rep. of Germany

[73] Assignee: Hermann Wangner GmbH & Co. KG, Reutlingen, Fed. Rep. of Germany

[21] Appl. No.: 309,893

[22] Filed: Feb. 14, 1989

Related U.S. Application Data

[63] Continuation-in-part of Ser. No. 104,905, Oct. 6, 1987.

[30] Foreign Application Priority Data

Oct. 7, 1986 [DE] Fed. Rep. of Germany ..... 3634134

[51] Int. Cl.[5] ..... D21F 7/10

[52] U.S. Cl. ..... 139/383 A; 428/224

[58] Field of Search ..... 139/383 A, 425 A; 428/224, 257; 162/DIG. 1, 348, 358

[56] References Cited

U.S. PATENT DOCUMENTS

| | | | |
|---|---|---|---|
| 4,314,589 | 2/1982 | Buchanan et al. | 139/383 A |
| 4,423,755 | 1/1984 | Thompson | 139/383 A |
| 4,564,051 | 1/1986 | Odenthal | 139/425 A |
| 4,592,396 | 6/1986 | Borel et al. | 139/383 A |

FOREIGN PATENT DOCUMENTS

| | | | |
|---|---|---|---|
| 206095 | 9/1987 | Japan | 139/383 A |

*Primary Examiner*—Andrew M. Falik

*Attorney, Agent, or Firm*—Sughrue, Mion, Zinn, Macpeak & Seas

[57] ABSTRACT

The fabric for the sheet forming section of a paper making machine includes a double-layer or multi-layer fabric of interwoven longitudinal and transverse threads and additional transverse threads floating on the paper supporting side. The additional transverse threads are interwoven in a plane disposed below the plane formed by the transverse threads of the paper supporting side. The additional transverse threads preferably have a smaller diameter than the ordinary transverse threads.

4 Claims, 3 Drawing Sheets

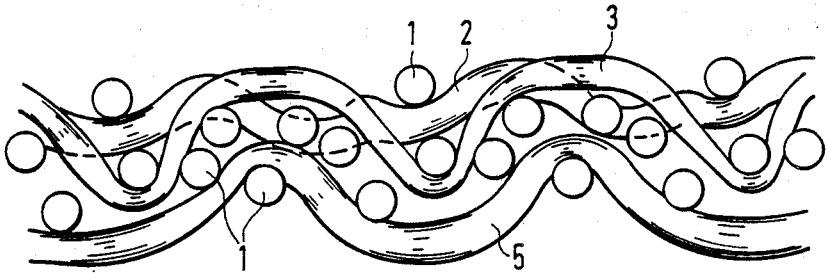
FIG. 1
FIG. 2
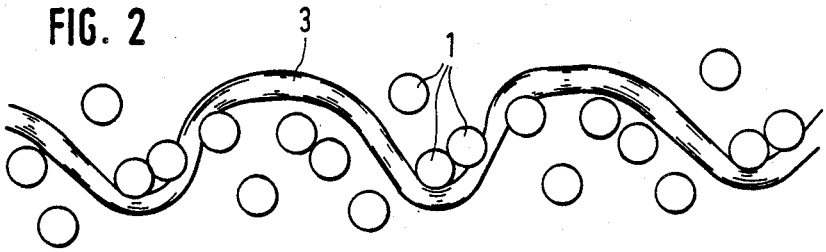

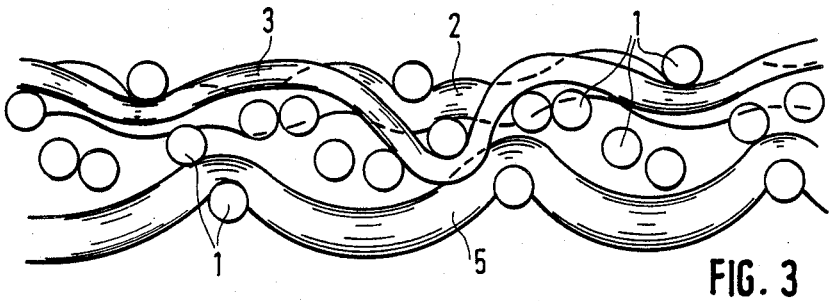
FIG. 3
FIG. 4
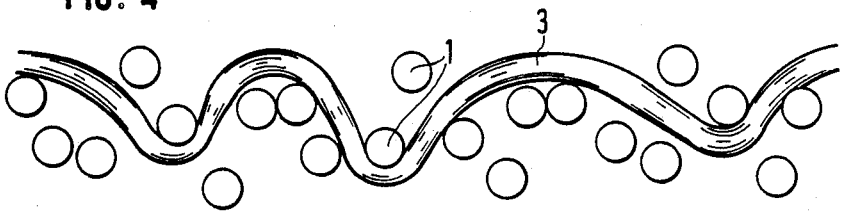

FABRIC FOR THE SHEET FORMING SECTION OF A PAPERMAKING MACHINE

This is a continuation-in-part of Ser. No. 104,905, filed Oct. 6, 1987.

BACKGROUND OF THE INVENTION

The invention relates to a fabric for the sheet forming section of a papermaking machine comprising a double-layer or multi-layer fabric of interwoven longitudinal and transverse threads and additional transverse threads floating on the paper supporting side.

Papermachine fabrics having additional transverse threads floating on the paper supporting side are disclosed in U.S. Pat. Nos. 4,182,381 and 4,281,688 and in European Patent Publication No. A-85 363. According to U.S. Pat. No. 4,182,381, the additional transverse threads are to reduce wear, especially in the region of a loop seam. According to U.S. Pat. No. 4,281,688 the transverse threads are so interwoven that on the paper supporting side and on the running side, there are floats of equal length, which is to counteract curling of the edges.

According to European Patent Publication No. A-85 363, the additional transverse threads floating on the paper supporting side are to improve the removal of the sheet and increase the permeability. The additional transverse threads are so interwoven that they are crimped as little as possible. However, this makes them project on the paper supporting side so far that they interfere with sheet forming. When the fabric is cleaned by high pressure water jets, the projecting threads are frequently destroyed.

SUMMARY OF THE INVENTION

The present invention has the object of providing a fabric of the initially indicated type for the sheet forming section of a papermaking machine which is less prone to destruction of transverse threads when cleaned by high pressure water jets. This object is realized in that the additional transverse threads floating on the paper supporting side are interwoven below the plane formed by the transverse threads of the paper side.

Preferably the additional, floating transverse threads are interwoven at such a low level that the entire cross section thereof, at the point of interweaving, is disposed deeper than the deepest position of the normal transverse threads participating in the formation of the paper side. Prerequisite for deep interweaving of the additional transverse threads is, in general, that the additional transverse thread interweaves with a longitudinal thread so that at least a portion of the longitudinal threads interweaving with the additional transverse threads extends under one or both of the adjacent paper side transverse threads. Preferably the additional, floating transverse threads consist of especially soft and readily extensible material.

The fabric can be woven flat or endless. As usual, the threads consist of synthetic resin monofilaments; generally a material of higher elastic modulus is selected for the longitudinal threads than for the transverse threads. Especially for endless woven fabrics, the threads may also consist of synthetic resin multifilaments. The additional floating transverse filaments preferably have a smaller diameter than the normal transverse filaments.

The foregoing and other objects, features and advantages of the invention will be apparent from the following more particular description of a preferred embodiment of the invention as illustrated in the accompanying drawings

BRIEF DESCRIPTION OF THE DRAWINGS

FIGS. 1 to 4 show four embodiments of the invention in cross-section along an additional transverse thread; in FIGS. 2 and 4, only the course of the additional transverse thread is shown;

DETAILED DESCRIPTION OF THE INVENTION

Figure 5:
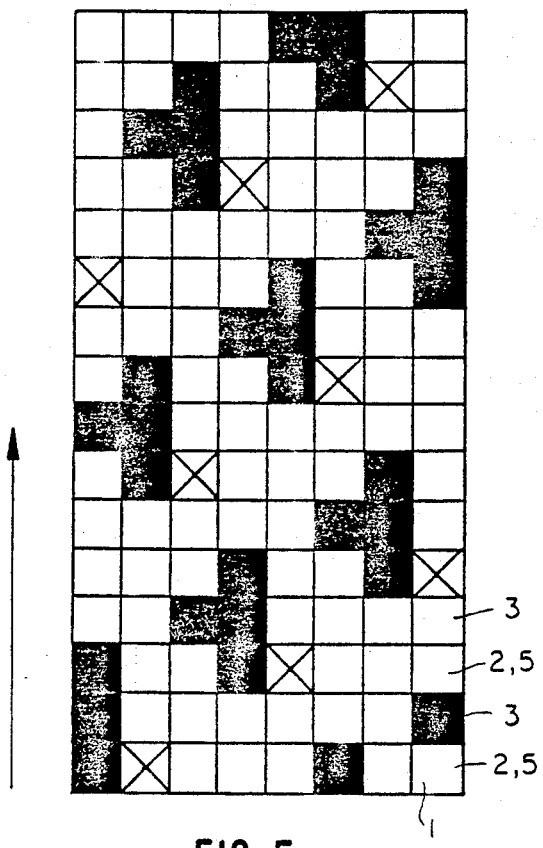
FIG. 5 shows the weave design of Example 1 where the arrow indicates the course of the warp or longitudinal threads, the black areas indicate that the warp is visible on the paper side, at the other crossing points on the paper side the weft or transverse threads are visible, and the cross in several areas again indicates that the warp is visible on the running side, i.e. that it passes beneath a pair of weft threads.

FIG. 1 shows in cross section a first embodiment of the present invention comprising a double-layer, eight-harness fabric. Double-layer in this context means a fabric containing two layers of transverse threads interwoven with a single system of longitudinal threads. The top side, or paper side, of the fabric is formed by mutually interwoven longitudinal threads 1 and upper transverse threads 2. To each one of the upper transverse threads 2, a lower transverse thread 5 is coordinated so that the transverse threads are arranged in pairs. The longitudinal threads 1 are also interwoven with the lower transverse threads 5. The lower transverse threads 5 have very long, downwardly projecting floats forming the running side of the papermachine fabric. Since the lower transverse threads 5 are especially exposed to wear, they suitably have greater diameter than the upper transverse threads 2 and partially consist of especially wear-resistant material, e.g. polyamide and polyester in turn.

Since the longitudinal threads 1 are interwoven with the upper transverse threads 2 and with the lower transverse threads 5, they extend partially on the paper side and partially on the running side of the fabric. Between the sites where the longitudinal threads 1 are interwoven with the upper and lower transverse threads 2 and 5, they also interweave with additional transverse threads 3. The transverse threads 3, apart from the points of interweaving with the longitudinal threads 1, extend on the paper side of the fabric where they form long floats.

The additional transverse threads 3 consist of a material having an elastic modulus no greater than the elastic modulus of the upper and lower transverse threads.

The embodiment illustrated in FIG. 1 has an eight-harness weave in which each weave pattern contains eight longitudinal threads and sixteen ordinary transverse threads 2, 5 and eight additional transverse threads 3. The floatings of the additional transverse threads 3 extend over six longitudinal threads 1.

In some weave patterns it may happen that an additional transverse thread 3 interwoven deep in the fabric interior is laterally urged out of the center of the binding. In the embodiment illustrated in FIG. 2, this is prevented since the additional transverse thread 3 is engaged from above by two longitudinal threads 1.

With this arrangement, the floats of the transverse threads 3 each extend over five longitudinal threads 1.

In the embodiment illustrated in FIG. 3, the basic weave, i.e. the weave pattern of the longitudinal threads 1 and the upper and lower transverse threads 2, 5, has a seven-harness structure. The additional transverse threads, however, interweave only with every fourteenth longitudinal thread 1, i.e. they interweave only in every second repeat of the basic weave pattern.

With respect to the basic weave pattern, the embodiment illustrated by FIG. 4 is identical with that of FIG. 3. The additional transverse threads 3, however, alternately floats over four and six longitudinal threads 1. Due to the non-uniform length of the floats of the additional transverse threads 3, the marking characteristics are improved. The non-uniform length of the floats results from the circumstance that the additional transverse threads 3 alternately interweave with differently extending longitudinal threads 1, e.g. alternately with the first and the second longitudinal thread of a repeat.

The following Examples 1 and 2 relate to a flat woven fabric for the sheet forming section of a papermaking machine so that the longitudinal threads are formed by the warp and the transverse threads are formed by the weft.

EXAMPLE 1

Figure 6:
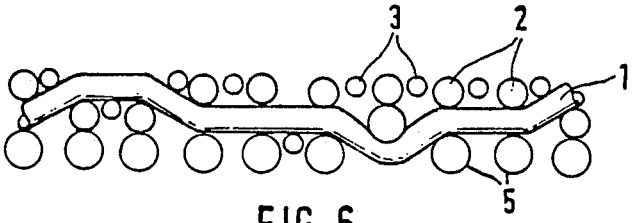
FIG. 6 is a sectional view showing the course of the longitudinal warp thread in Example 1.

The basic fabric is a double layer fabric in eight-harness weave. The warp extends as follows: The warp thread 1 passes over two weft pairs 2, 5, then between three weft pairs 2, 5, below one weft pair 2, 5, and finally between two weft pairs 2,5, returns to the paper side and repeats the pattern (see FIG. 6). The floats of the warp 1 on the paper side have eight-harness satin distribution (see FIG. 5).

The fabric was woven with a warp density of 38 threads/cm. After setting, the warp number increases to 42 threads/cm owing to the transverse shrinkage of the fabric. The warp consists of monofilamentary polyester of 0.30 mm diameter. The material is longitudinally stable, i.e. it has a high elastic modulus.

The weft threads of the upper layer have a density of 14 threads/cm after weaving. After setting, the fabric has 13.5 weft threads/cm. The weft diameter is 0.30 mm. It consists of Trevira 900 type polyester monofilament material having a soft thread quality corresponding to an extension of 23.4% at 27 cN/tex.

The weft threads 5 of the running side are woven so that they are disposed precisely below the weft threads 2 of the upper layer. They alternately consist of polyester monofilament of 0.32 mm diameter of the same material as the weft in the upper layer, and of polyamide monofilament, also 0.32 mm in diameter, of the Pa 6.6 type.

For subdivision of the mesh opening weft threads 3 of polyester monofilament of 0.15 mm diameter of the same soft Trevira 900 type material as the other weft threads are interwoven into the upper layer. The course of an additional weft thread 3 is shown in FIG. 1, i.e. the additional weft thread passes over six warp threads 1 and under two warp threads 1. At the point of interweaving, the additional weft thread 3 is disposed in the plane of the lower weft threads 5.

The set fabric has an elongation of 0.6% under a load of 100 N/cm and an air permeability of 8000 $m^3/m^2/h$. On the paper side, the warp floats and the floats of the ordinary weft threads 2 and of the additional weft threads 3 are disposed in same plane. On the running side, the weft threads 5 are disposed 15.5/100 mm deeper than the warp crimp. This implies that the fabric is a weft runner. Only after 15.5/100 mm thickness has been consumed do the lowermost portion of the warp threads come in contact for the first time with the papermachine, i.e. at the time the warp threads are subject to wear for the first time. As shown in FIG. 1, the point of interweaving of the additional weft 3 is hidden so deeply in the fabric interior that the additional weft threads, although deeply interwoven, are not subject to wear.

This eight-harness double-layer fabric is used for the manufacture of cardboard. Owing to its high retentivity, the fabric can be equally advantageously employed for the manufacture of packaging paper and similar heavy types of paper for packaging uses.

EXAMPLE 2

The fabric is made in a 14 harness weave, and the warp 1 passes over two weft pairs 2, 5, between one weft pair 2, 5, below one weft pair 2, 5, and between three weft pairs 2, 5. The paper side has a 7-harness satin distribution of the warp floats. After weaving, the warp 1 has 54 threads/cm and after thermosetting 60 threads/cm. The warp threads consists of polyester monofilament of 0.17 mm diameter having a longitudinally stable thread quality with high elastic modulus. The weft threads 2 of the upper layer consist of polyester monofilaments of 0.17 mm diameter, (Trevira 901) and have a medium elastic modulus (elongation 19% under a load of 27 cN/tex). After weaving, the fabric contains 19 weft threads/cm and the final fabric contains 17.5 ordinary weft threads/cm.

On the running side, the fabric, after weaving, has 19 weft threads 5 of 0.20 mm diameter per cm, half polyester, soft Trevira 900 type quality (23.4% elongation under a load of 27 cN/tex) and the other half type 6.6 polyamide.

Between each ordinary pair of weft threads an additional weft is interwoven in 14-harness weave as shown in FIG. 3. The additional weft also consists of polyester, soft Trevira 900 type quality, and has a diameter of 0.12 mm. The basic fabric is woven in 7-harness weave with the additional weft threads being interwoven only after each 14th warp thread rather than after each 7-harness repeat.

On the paper side, the warp threads, the weft threads, and the additional weft threads are all disposed on one plane. On the running side, the weft is disposed 9/100 mm deeper than the warp, i.e. the fabric is a weft runner.

The fabric of Example 2 has a fine surface structure and is used predominantly for writing and printing paper types that are sensitive to paper marks.

While the invention has been particularly shown and described with reference to preferred embodiments thereof, it will be understood by those in the art that the foregoing and other changes in form and details may be made therein without departing from the spirit and scope of the invention.

What is claimed is:

1. A fabric for the sheet forming section of a paper making machine comprising a double-layer fabric having a longitudinal thread system interwoven with three transverse thread systems including upper layer transverse threads and lower layer transverse threads disposed in pairs one over the other and additional transverse threads, each additional transverse thread having floats on the paper supporting side of the fabric in the same plane as the upper transverse threads and being interwoven by at least one longitudinal thread in the level of the lower transverse threads, the additional transverse threads being disposed at the point of interweaving in the plane of the lower transverse threads.

2. A fabric according to claim 1 wherein the additional transverse threads are interwoven with the longitudinal threads at such a low level that the entire cross section of the additional transverse threads, at the site of interweaving, is disposed deeper in the fabric than the deepest position of the upper layer transverse threads participating in the formation of the paper supporting side.

3. A fabric according to claim 1 wherein the additional transverse threads have a smaller diameter than the upper and lower layer transverse threads.

4. A fabric according to claim 1, wherein the additional transverse threads consist of a material having an elastic modulus no greater than the elastic modulus of the upper and lower layer transverse threads.

* * * * *